United States Patent [19]

Matthies et al.

[11] Patent Number: 4,784,342

[45] Date of Patent: Nov. 15, 1988

[54] DEVICE FOR SIMULTANEOUS SPOOLING A PLURALITY OF THREADS

[75] Inventors: Claus Matthies, Neumünster; Ernst Vehling, Bordesholm, both of Fed. Rep. of Germany

[73] Assignee: Neumünstersche Maschinen- Und Apparatebau GmbH, Neumünster, Fed. Rep. of Germany

[21] Appl. No.: 52,730

[22] Filed: May 20, 1987

[30] Foreign Application Priority Data

Jun. 7, 1986 [DE] Fed. Rep. of Germany ..... 3619286

[51] Int. Cl.[4] ..... B65H 54/02; B65H 54/20

[52] U.S. Cl. ..... 242/18 PW; 242/35.5 R

[58] Field of Search ..... 242/18 PW, 18 A, 18 DD, 242/25 A, 35.5 R

[56] References Cited

U.S. PATENT DOCUMENTS

| | | | |
|---|---|---|---|
| 3,421,362 | 1/1975 | Symborski | 242/18 G |
| 3,964,721 | 6/1976 | Owens et al. | 242/18 PW |
| 4,083,505 | 4/1978 | Burkhardt | 242/18 PW |
| 4,136,834 | 1/1979 | Tschentscher | 242/18 PW |
| 4,230,283 | 10/1980 | Hamaguchi et al. | 242/18 PW |
| 4,313,576 | 2/1982 | Claret et al. | 242/18 PW |
| 4,437,617 | 3/1984 | Cardell | 242/18 PW X |
| 4,456,187 | 6/1984 | Bloomfield et al. | 242/18 PW |
| 4,465,242 | 8/1984 | Ari et al. | 242/18 PW |
| 4,477,032 | 10/1984 | Pfyffer et al. | 242/18 PW |
| 4,646,981 | 3/1987 | Ohayon | 242/18 PW |

FOREIGN PATENT DOCUMENTS

| | | | |
|---|---|---|---|
| 0051223 | 10/1981 | European Pat. Off. . | |
| 1922241 | 11/1969 | Fed. Rep. of Germany . | |
| 2943392 | 5/1980 | Fed. Rep. of Germany . | |
| 3136908 | 5/1982 | Fed. Rep. of Germany . | |
| 2627643 | 3/1983 | Fed. Rep. of Germany . | |
| 56774 | 4/1985 | Japan | 242/18 PW |
| 7000712 | 6/1971 | Netherlands . | |
| 2011962 | 7/1979 | United Kingdom . | |

*Primary Examiner*—Stanley N. Gilreath

*Attorney, Agent, or Firm*—Michael J. Striker

[57] ABSTRACT

A device for spooling multiple threads includes a plurality of spools situated on a spool mandrel having pirns with spreading thread guides which are displaceable on the end of the spool mandrel parallel thereto to the spreading position which corresponds to the position of the tuck slots of individual pirns. A pivotable spreading flap is provided in the device, which has guide slots for exact positioning of the threads relative to the tuck slots of individual pirns.

7 Claims, 9 Drawing Sheets

DEVICE FOR SIMULTANEOUS SPOOLING A PLURALITY OF THREADS

BACKGROUND OF THE INVENTION

The invention relates to a device for simultaneous spooling of a plurality of threads.

Spooling devices of the type under discussion have been known. One of such devices has been disclosed in DE-PS No. 26 27 643. In this device, the guiding arrangement for spreading thread guides is formed as a swinging bar. When the swinging bar is in its base or initial position the spreading thread guides can be displaced from the threading position to the spreading position without contacting the pirns or holders by the running threads. By the lowering of the swinging bar the threads on the sleeves or bobbins are brought to the spooling mechanism. Since it is very difficult to bring the spreading thread guides exactly against the corresponding tuck slots the aforementioned patent offers that the threads would be first moved or lifted over the tuck slots and then guided back. However, the conventional arrangement does not ensure that each thread is engaged by a respective tuck slot; some threads due to the arrangement of the stationary inflow thread guides do not exactly run in the planes of the respective tuck slots. For stronger threads or filaments with the whole fineness of greater than about 500 den, the known device can not ensure that the threads would tear off in the tuck slots of the holders or pirns.

DE-OS No. 31 36 908 discloses a device which is substantially similar to that described above. In addition to the above-described arrangement however the inflow thread guides are movable and postionable along the arms. They can be selectively brought to the first position in which they would lie at the end of the arm one next to the other, or to the second position in which they would be positioned centrally above the spools.

SUMMARY OF THE INVENTION

It is an object of the present invention to provide an improved device for spooling multiple threads or filaments.

It is another object of the invention to provide a device for spooling multiple threads in which the thread spreading process would be precise and damage-free.

These and other objects of the invention are attained by a device for simultaneous spooling a plurality of threads, comprising a machine housing; a spool mandrel having a plurality of pirns provided with tuck slots; inflow thread guides arranged on the machine housing and spaced from each other; a traverse motion device including changing thread guides for individual pirns; spreading thread guides which are selectively movable for a parallel guidance relative to said spool mandrel to a threading position on a free end of said spool mandrel or to a position of the tuck slots of individual pirns at least near a respective spreading position, and a movable auxiliary organ having an edge and thread guiding slots arranged on said edge which is movable in a thread path and parallel to an axis of said spool mandrel, and positions of said guiding slots exactly coinciding with positions of said tuck slots.

The auxiliary organ executes a double function. Not only it serves for position deviations of the spreading thread guides for an exact positioning of the threads against the tuck slots of individual pirns but also this auxiliary organ displaces the threads to be spread in the direction towards the pirns and brings the threads on the pirns to the spooling mechanism. Thereby the pivoting of the guides can be omitted.

The auxiliary organ may be formed by a spreading flap which is pivotable about an axis parallel to the axis of said spool mandrel.

The inflow thread guides may be movable to a threading position and a spreading position, whereby the insertion of the threads into the inflow thread guides is facilitated, and the threads would run exactly in the planes of the tuck slots.

Blades may be provided adjacent said thread guiding slots.

The spreading flap may include resiliently supported thread guide blocks in which said thread guide slots are provided, at least one blade corresponding to each thread guide block, each blade having a cutting edge crossing a stroke path of the respective thread guide block.

The auxiliary organ may include a rod, said blades being positioned on said rod which is arranged parallel to the edge provided with said thread guide slots and is reciprocally movable in the direction of an axis thereof.

The auxiliary organ may include a pulling cable which effects a movement of said rod, said movement being coupled with a pivoting motion of said spreading flap.

The blades may be screened at two sides thereof by thread guide plates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
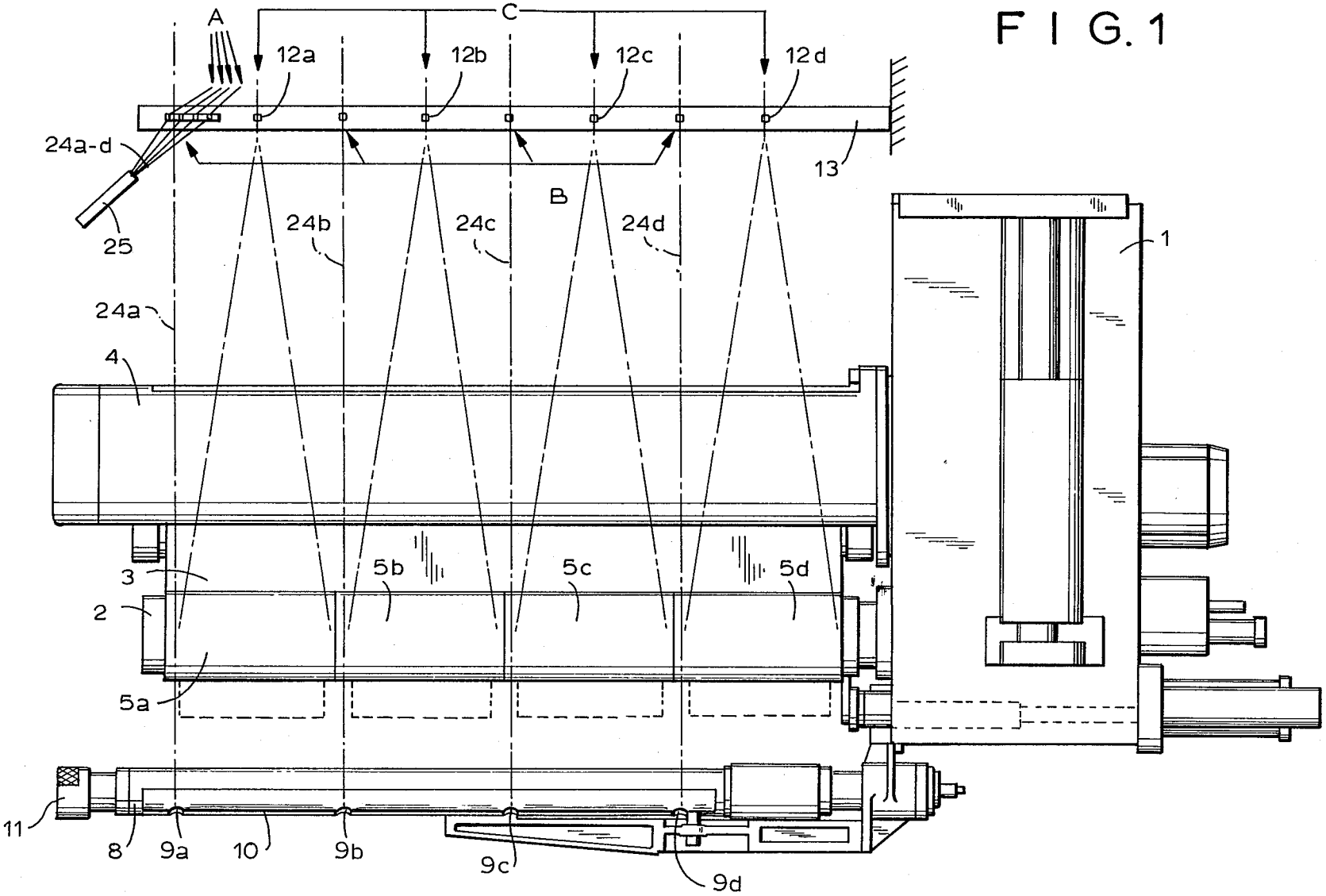
FIG. 1 is a side view of the device according to the invention.
Figure 2:
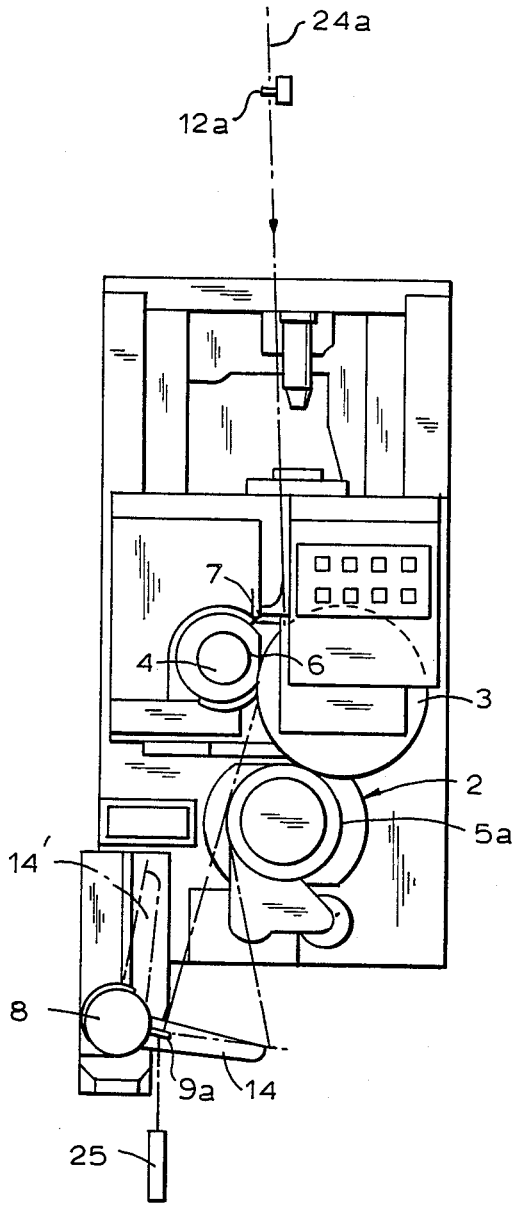
FIG. 2 is a front view of the device of FIG. 1.
Figure 3:
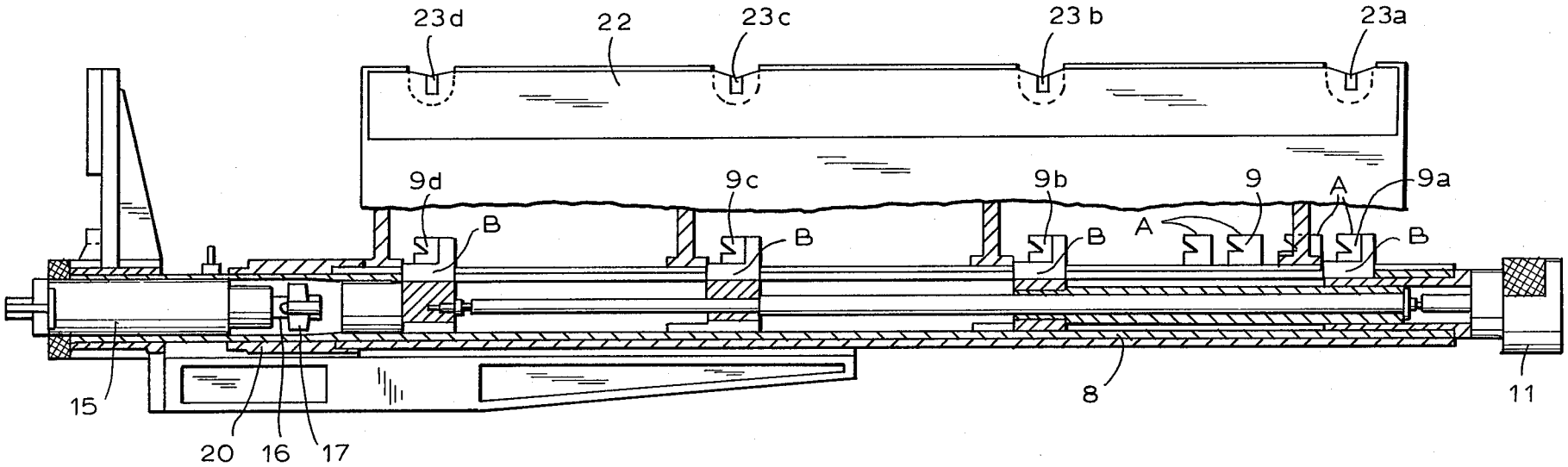
FIG. 3 is a sectional view of the guide tube of the device of FIG. 1.

Referring now to the drawings in detail, and firstly to FIGS. 1–3 thereof, it will be seen that a projecting bobbin mandrel 2, a driving roller 3, and a traverse motion device 4 are mounted in the known manner on a machine housing 1.A plurality of sleeves 5*a* to 5*d* are situated one next to the other on the bobbin mandrel 2. Each sleeve has at the left-hand end thereof a tuck slot. The traverse motion device 4 has in accordance with the number of pirns 5*a* to 5*d* the same number of traversing or changing thread guides. 6. A narrow deflecting flap 7 is positioned above the traverse motion device 4. The deflecting flap 7 extends over the entire length of the traverse motion device. The deflecting flap 7 can be moved pneumatically from the somewhat vertical base position to the inclined position shown in FIG. 2 by an suitable conventional means.

A guiding tube 8 for a plurality of spreading thread guides 9*a*–9*d* is positioned below the bobbin mandrel 2 and is immovably connected to the machine frame. The guide tube 8 is provided at its side, which faces the bobbin mandrel 2, with an elongated slot 10. Spreading thread guides 9*a*–9*d* extend approximately horizontally through the elongated slot 10. The guides 9*a*–9*d* are connected inside the guide tube 8 with a rod, as described, for example in DE-PS No. 26 27 643. This rod enables the thread guides 9*a*–9*d* with the aid of a grip 11 to be selectively brought to a threading position A or a spreading position B+, as shown in FIG. 3. In the position A, the grip or hand 11 is pulled out and in this position A, the spreading thread guides 9*a*–9*a* lie, as shown with dashed lines at the right-hand side of FIG. 3, closely adjacent to each other at the collar-shaped end of the guide tube 8. Each spreading thread guide 9*a*–9*d* in the position B is positioned at least in the plane of the tuck slot of the assigned pirns 5*a*–5*d*, and the grip 11 has the position as illustrated in FIGS. 1 and 3.

A plurality of inflow thread guides 12*a*–12*d* are provided at intervals from each other over the machine frame 1. Guides 12*a*–12*d* are, similarly to the spreading thread guides 9*a*–9*d*, displaced on a stationary machine rail 13 parallel to the axis of the bobbin mandrel 2 selectively between a threading position A and a spreading thread position B. In addition, an operation position C is provided, in which each inflow thread guide 12*a*–12*d* is positioned exactly above the center of the corresponding changing region. For the displacement of the inflow thread guides 12*a*–12*d*, a non-shown pneumatic cylinder can be provided, which can be coupled with the pneumatic system of the deflecting flap 7.

As can be seen in FIG. 3, the thread guide 9*a* is connected to a sleeve 101 which is plugged into the free end of tube 8 up to a stop. The thread guides 9*b* and 9*d* are situtaed each on a respective short guide piece 102, 103, 104. The guide piece 104 is secured to the end of a rod 105 the other end of which is secured to the grip 11. Rod 105 penetrates coaxial bores of the guide piece of sleeve 101 and guide pieces 102, 103. The rod 105 has a stepped diameter. From the end which is connected to grip 11 to the guide piece 101, is the rod 105 enlarged to form a tubular portion 106. This tubular portion 106, at the end, which faces away from the grip 11, is reduced over the length which corresponds to the length of the guide piece 102. The guide piece 102 is positioned at this end with a small play so that it abuts at the side thereof against a shoulder 107. The other side of the guide piece 102 butts against a stop 108 which is connected to the inner wall of tube 8.

At the end of rod 8, which is near the guide piece 104, the diameter of the rod is further reduced over about one third of its length. On this portion of the rod 105, is situated with a small play, the guide piece 103 so that this guide piece abuts against a shoulder 109 which is formed by the step of rod 105. The other side of the guide piece 103 abuts against a stop 110 which is connected to the inner wall of tube 8.

The guide piece 103 has, in the direction of elongation thereof, a recess 111, the cross-section of which corresponds to that of stop 108. The guide piece 104 has, in the longitudinal direction, a recess 112, the cross-section of which corresponds to that of stop 110.

By pulling out of the hand grip 11 the guides 9*a* to 9*d* are displaced from the position B to the position A. When the grip 11 is pulled out firstly only the thread guide 9*b* with the guide piece 104 rigidly connected to the rod 105 is moved. Upon further pulling the guide piece 104 strikes against the guide piece 103 and makes the latter move with the thread guide 9*c*. Thereby the recess 112 allows the guide piece 104 to pass the stop 110. Upon further pulling of the hand grip 11, the guide piece 103 abuts against the guide piece 102 and recesses 112 and 111 allow the guide pieces 104 and 103 to pass the stop 108. Now the guide pieces 104, 103 and 102 together with thread guides 9*d*, 9*c*, 9*b* move in the direction towards the guide 9*a* until the position A is reached, in which position all thread guides 9*a* to 9*d* are positioned closely adjacent to one another.

In order to move the thread guides back to the position B the rod 105 is moved by means of the hand grip 11 in the tube 8. Firstly, the guide pieces 103 and 102 follow this movement until shoulders 109 and 107 abut against these guide pieces. The guide pieces 104 passes stops 108 and 110. The guide piece 102 passes the stop 108 and abuts against the wider stop 110. At the same time, the guide piece 102 abuts against stop 108. The thread guides again reach the position B.

Sleeve 20 is connected to the sleeve 113 on which levers 21 of flap 14 are positioned, as shown in FIG. 3.

Thread guides 12*a* to 12*d* are movable from position A to position B in the same manner as that of the thread guides 9*a* to 9*d*.

Figure 6:
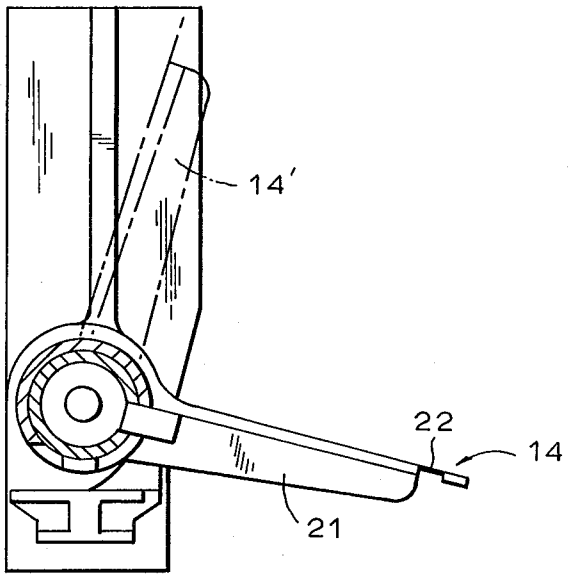
FIG. 6 is a side view of the spreading flap of the device of FIG. 1.
Figure 4:
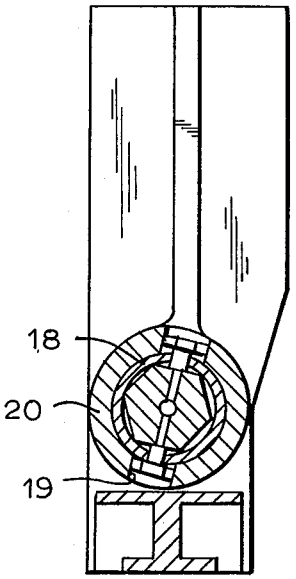
FIG. 4 shows a sectional view of the guide tube sleeve.
Figure 5:
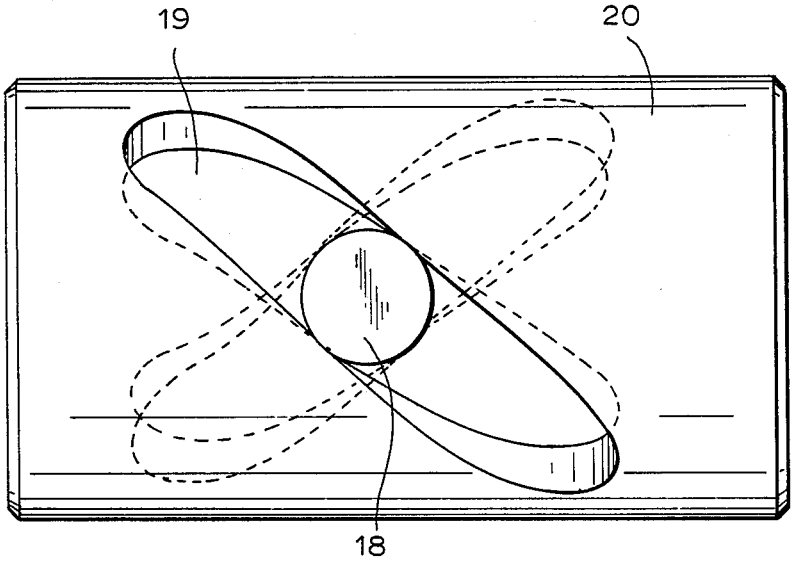
FIG. 5 shows a side view of the sleeve of FIG. 4.

For the exact simultaneous spreading of a plurality of threads 24*a*–24*d* a spreading flap 14 is provided as the auxiliary organ. The flap 14 is pivotable about the axis of the guide tube 8 from the ready position for spreading to an end position after the spreading process. In the ready position which is indicated with dash-dotted lines in FIG. 6 and designated with reference manual 14', the spreading flap is pivoted to the almost vertical position upwardly. The end position of the spreading flap 14 is shown in FIG. 6 with solid line. The spreading flap is almost horizontal in that end position with a slight inclination forwardly. For the pivoting of the spreading flap 14 a pneumatic cylinder 15 (shown in FIG. 3) is accommodated in the guide tube 8 at the housing end thereof. A drive element 17 is secured to a piston rod 16 of the pneumatic cylinder 15. Pins 18, clearly shown in FIG. 4, are situated on the drive element 17. Pins 18 extend through recesses of the guide tube 8 and engage in oblique grooves 19 of a sleeve 20. The latter is rotatable but immovable in the axial direction on the guide tube 8. Sleeve 20 forms together with the spreading flap 14 an integral unit.

The spreading flap 14 includes substantially a number of levers 21 and a strip-shaped thread-guiding sheet 22 which is rigidly screwed to levers 21. The thread-guiding sheet 22 at its front end is provided with a plurality of thread-guiding blocks 23*a*–23*d* which are inserted into and secured in triangular recesses. Each thread guiding block 23*a*–23*d* (FIG. 3) is positioned with its slot immovably exactly in the plane of the tuck slot of the respective holder or pirn 5a–5d.

The spreading of threads 24a–24b is executed in the device of this invention in the following manner:

A certain number of holders 5a–5d, in the exemplified embodiment four, are set on the bobbin mandrel 2. The drive motor is switched on, and the drive roller 3 is lowered down to contact with the holders or pirns 5. The inflow thread guides 12a–12d arranged over the machine, as well as spreading guides 9a–9d, are brought to the threading position A. The deflecting flap 7 is pivoted from the vertical base position to the pivoted or inclined position shown in FIG. 2. The spreading flap 14 is pivoted to the approximately vertical position 14'.

Threads 24a–24a arriving from the non-illustrated spinning shaft are taken by a conventional spreading injector 25 and inserted into the inflow thread guides 12a–12d. The latter are moved to the spreading position B. For the inflow thread guide 12a the spreading position coincides with the threading position.

Threads 24a–24d are now guided with the aid of the injector 25 between the drive roller 3 and the traverse motion device 4 from the operator side and inserted into the spreading thread guides 9a–9d. Thereby the deflecting flap 7 prevents the threads from being engaged by the guides 6 of the traverse motion or changing device 4. Because of the arrangement of the guide tube 8 laterally offset to the axis of the bobbin mandrel, threads 24a–24d do not contact holders 5a–5d at the beginning. Now the thread guides 9b–9d are displaced to the spreading position B. For the guide 9a its spreading position coincides with the threading position. The the threads run except for possible somewhat non-precise positioning of the thread guide 9b–9d, in the planes of the tuck slots of holders 5a–5d. The tuck slots are not seen in FIG. 1 because they are covered with the lines which represent the vertically extended threads 24a–24d.

Now the spreading flap 14 is pivoted to its end position. The front edge of this flap, on which the thread guide blocks 23a–23d are provided, comes in contact with threads 24a–24d. Thereby the threads slide over the edges of the triangular recesses into the slots of the thread guide blocks 23a–23d. Slight lateral deviations of the course of running of the threads are thereby corrected by the aforesaid described position. Shortly before the spreading flap 14 reaches its end position, the threads are engaged by the tuck slots of holders 5a–5d, torn off and spooled in the region of the tuck slots to form a spool. Now the deflecting flap 7 in pivoted back to its base position and, simultaneously, the inflow thread guides 12a–12d are displaced to the operation position C. Each thread beings to move in the direction towards the center of the assigned changing or traverse motion regions. Thereby each thread is independently engaged by a corresponding changing thread guide 6. The spool formation starts.

Figure 7:
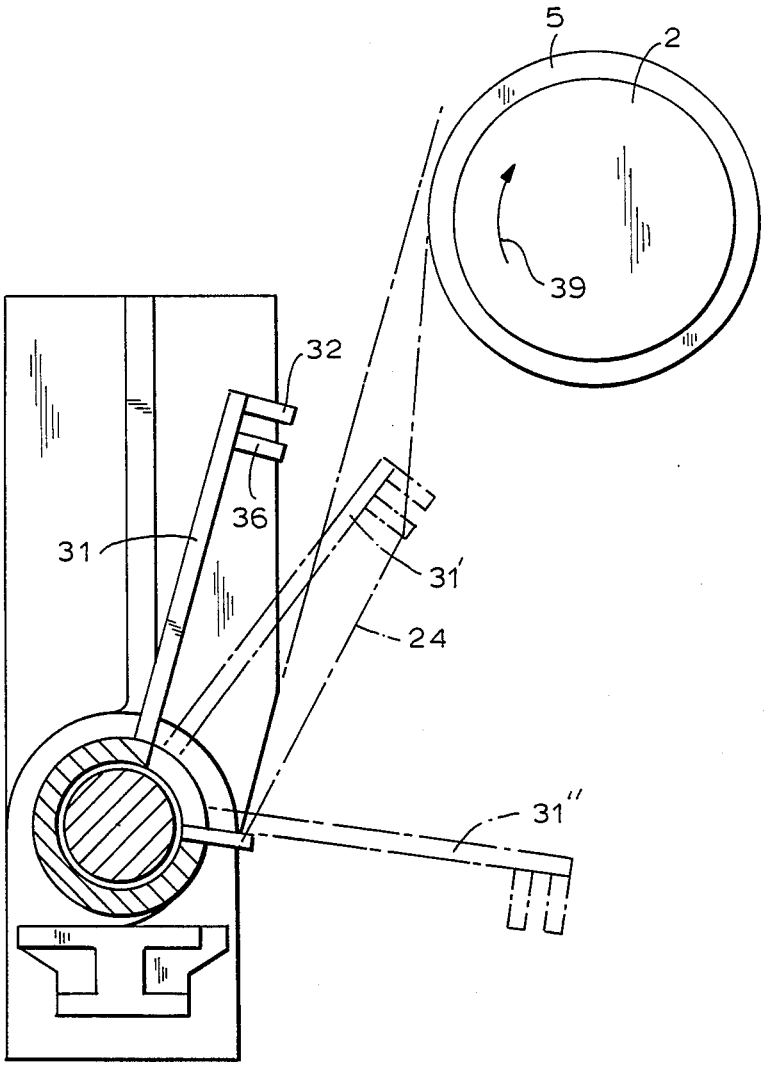
FIG. 7 is a schematic, partially sectional, side view of a modified embodiment of the device for a simultaneous spooling of a plurality of threads.
Figure 9:
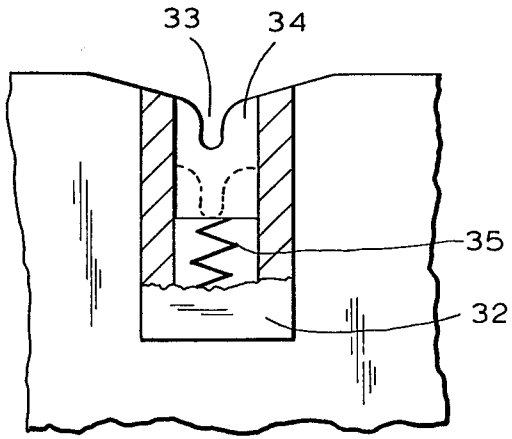
FIG. 9 is a side view, partially in section, of a slide shoe of the device show in in FIG. 7.
Figure 8:
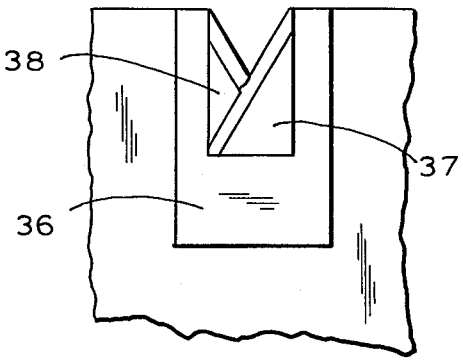
FIG. 8 is a side view of a holder with two blades of the device of FIG. 7.

FIGS. 7 to 9 show a modified embodiment of the spreading flap for multifil threads for a greater titer than 500 dtex. This modified embodiment is recommendable for monofil threads below 500 dtex and for the holders which are used often because in the latter case the tuck slots do not have their original structure.

The spreading flap 31 is provided at the front edge thereof with slide shoes 32 having strips extended at right angles from the plane of the flap. Slide shoes 32 point in the almost vertical position of the flap 31 in the direction towards the bobbin mandrel 2. Thread guiding blocks 34 provided with thread guiding slots 33 are positioned in the slide shoes 32 as shown in FIGS. 8 and 9. Each thread guiding block is movable within its slide shoe 32 along a stroke and is resiliently supported by a spring 35. Slightly below each slide shoe 32, is provided a support or holder 36 the shape and dimension of which correspond to those of the slide shoe 32. Two oblique blades 37, 38 are secured to holder 36. These blades have cutting edges which form a V therebetween and cross, as viewed in the direction towards the pivot axis of flap 31, the stroke of the thread guiding block 34, which stroke is effected by spring 35.

Upon the pivoting of the flap 31 from the vertical base position to the position 31' shown in FIG. 7 by dash-dotted lines, threads 24 are engaged by the thread guiding slots 33, exactly guided and inserted into the tuck slots of the holders 5 which rotate in the direction indicated by arrow 39 in FIG. 7. During the insertion into the tuck slots of holder 5 a pulling force is suddenly increased. Thereby the thread guiding blocks 34 are displaced back against the restoring force of springs 35. The threads arrive at the cutting edges of blades 37, 38 and are cut off. The flap 31 rotates to its maximal end position 31''.

Figure 10:
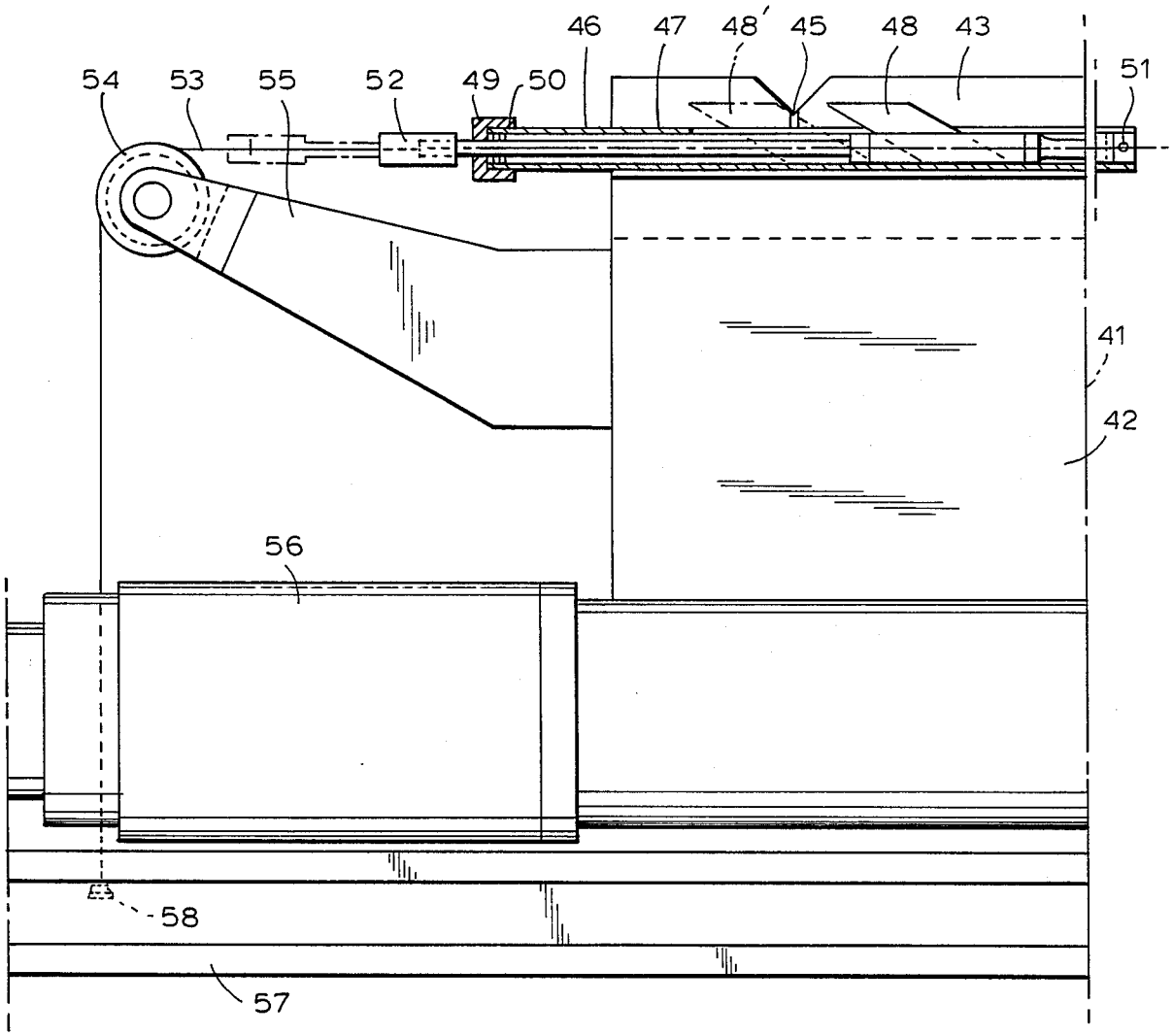
FIG. 10 is a side view, partially in section of the device of yet another embodiment of the invention.
Figure 11:
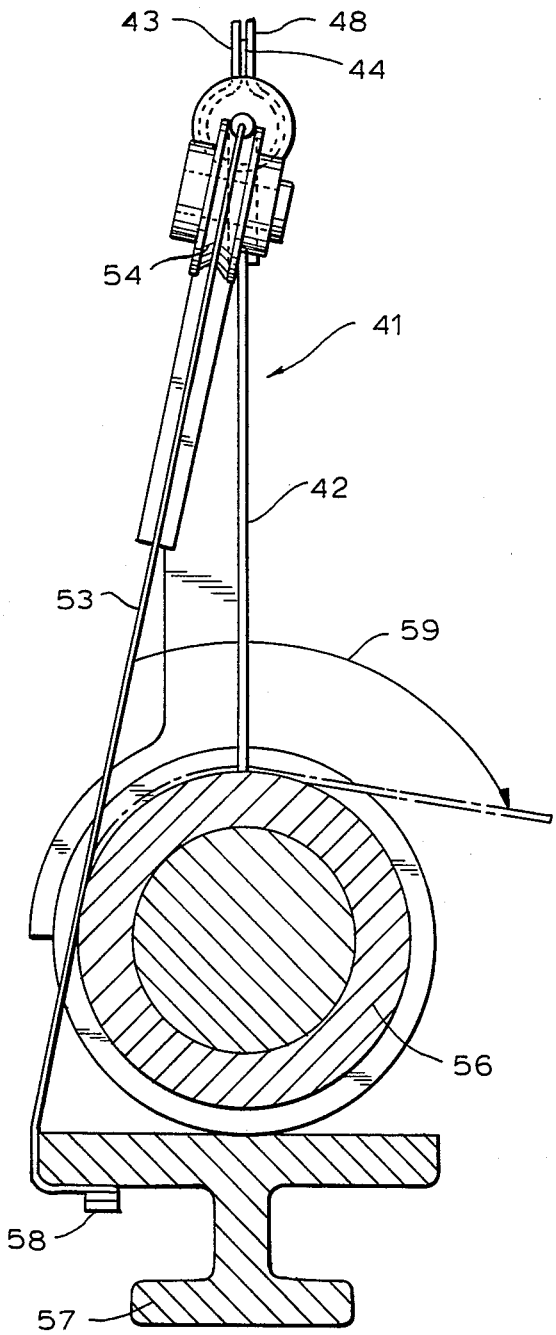
FIG. 11 is a side view, partially in section, of a spreading flap of the device of FIG. 10.

In the embodiment shown in FIGS. 10 and 11, the spreading flap 41 has a base body 42, at the front edge of which are two mirror-inverted symmetrical tube-shaped profiled plates 43, 44 are secured. These plates 43, 44 are provided at the free ends with thread guiding slots 45. Both half-shells of the thread guide plates or sheets 43, 44 surround a tube 46 which has at the side, which faces the slot 45, an elongated slot. A rod 47 is guided in tube 46 which is provided with a plurality of inclined blades 48, the number and the arrangement of which correspond to that of the thread guiding slots. The blades 48 which extend through the slots of tube 46 are overlapped at both sides with flat edge strips of the profiled plates 43, 44. At the other end of tube 46, which faces the machine housing, is situated a screw cap 49 which serves as a bearing or support for a helical spring 50. This spring presses with its other end against the thickened part of the rod 47 so that this rod abuts against a stop 51 provided at the operator end of tube 46. At the end of rod 47, extended outwardly from the screw cap 49, is secured by means of a holder 52, a pulling cable 53. The cable 53 runs over a roller 54 which is supported on a boom 55 fastened to the spreading flap 41. Cable 53 is further guided tangentially over a sleeve 56 towards a traverse 57 rigidly connected to the machine frame 1 and is connected thereto by a screw 58. The sleeve 56 corresponds to the sleeve 20 mentioned in connection with FIG. 1. The pulling cable 53, upon the pivoting of the spreading flap 41 in FIG. 11 in the direction of arrow 59, pulls the rod 47 independently in the direction to the roller 54. The blade 48 is thereby moved to the position designated by 48'. The blade thus passes the slot 45 and cuts the thread lying therein.

In place of the pulling cable 53 the movement of rod 47 can be executed by any other suitable means, for example by pneumatic cylinder. The release of the rod could be then obtained by the flap via an end switch.

It will be understood that each of the elements described above, or two or more together, may also find a useful application in other types of devices for simultaneous spooling a plurality of threads differing from the types described above.

While the invention has been illustrated and described as embodied in a device for simultaneous spooling a plurality of thread, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A device for simultaneous spooling a plurality of threads, comprising a machine housing; a spool mandrel having a plurality of pirns provided with tuck slots; inflow thread guides arranged on the machine housing and spaced from each other; a traverse motion device including changing thread guides for individual pirns; spreading thread guides and means for mounting the spreading thread guides for selective movement to a threading position wherein all the guides are at a position adjacent one end of the spool mandrel and a spreading position wherein a respective guide is substantially in the plane of a tuck slot of a respective pirn; a movable auxiliary organ having an edge and thread guiding slots arranged on said edge, the number of said inflow thread guides and guiding slots each corresponding to at least the number of threads and pirns, said auxiliary organ being a spreading flap wherein a respective guiding slot is exactly aligned and coincides with a respective tuck slot; and means for mounting said flap for selective movement to a postion spaced from a thread path extending from the inflow thread guides to the spreading thread guides and a position wherein the thread guiding slots engage the threads and move the threads into their respective tuck slots.

2. The device as defined in claim 1, wherein said spreading flap is pivotable about an axis parallel to the axis of said spool mandrel.

3. The device as defined in claim 2, wherein blades are provided adjacent said thread guiding slots.

4. The device as defined in claim 3, wherein said spreading flap includes resiliently supported thread guide blocks in which said thread guide slots are provided, at least one blade corresponding to each thread guide block, each blade having a cutting edge crossing a stroke path of the respective thread guide block.

5. The device as defined in claim 3, said auxiliary organ including a rod, said blades being positioned on said rod which is arranged parallel to the edge provided with said thread guide slots and is reciprocally movable in the direction of an axis thereof.

6. The device as defined in claim 5, said auxiliary organ including a pulling cable which effects a movement of said rod, said movement being coupled with a pivoting motion of said spreading flap.

7. The device as defined in claim 5, wherein said blades are screened at two sides thereof by thread guide plates.

* * * * *